United States Patent [19]

Saar

[11] Patent Number: 4,510,066

[45] Date of Patent: Apr. 9, 1985

[54] RETARDING SETTING OF CRUTCHER SLURRY FOR MANUFACTURING BASE BEADS FOR DETERGENT COMPOSITIONS

[75] Inventor: David C. Saar, Belle Mead, N.J.

[73] Assignee: Colgate-Palmolive Company, New York, N.Y.

[21] Appl. No.: 511,318

[22] Filed: Jul. 6, 1983

[51] Int. Cl.[3] ..... C11D 3/04; C11D 3/10; C11D 3/12; C11D 11/02

[52] U.S. Cl. ..... 252/140; 252/89.1; 252/91; 252/135; 252/160; 252/174; 252/174.14; 252/174.21; 252/174.24; 252/174.25

[58] Field of Search ..... 252/89.1, 135, 140, 252/174.14, 174.21, 174.24, 179, 91

[56] References Cited

U.S. PATENT DOCUMENTS

| | | | |
|---|---|---|---|
| 3,554,916 | 1/1971 | Kerfoot | 252/545 |
| 3,951,879 | 4/1976 | Wixon | 252/547 |
| 4,054,541 | 10/1977 | Mausner | 252/532 |
| 4,139,486 | 2/1979 | Bailey | 252/135 |
| 4,166,039 | 8/1979 | Wise | 252/110 |
| 4,294,718 | 10/1981 | Kaeser | 252/135 |
| 4,368,134 | 1/1983 | Kaeser | 252/140 |
| 4,417,994 | 11/1983 | Stoddart | 252/135 |

FOREIGN PATENT DOCUMENTS

| | | | |
|---|---|---|---|
| 2097419 | 11/1982 | United Kingdom | 252/140 |

*Primary Examiner*—Dennis L. Albrecht
*Attorney, Agent, or Firm*—Bernard Lieberman; Herbert S. Sylvester; Murray M. Grill

[57] ABSTRACT

A process is described for retarding or preventing the setting of a miscible and pumpable crutcher slurry intended to be spray dried to base beads for subsequent conversion to a built synthetic organic nonionic detergent composition. The slurry, which contains described proportions of water softening zeolite, water soluble salt(s), including sodium bicarbonate and sodium carbonate, and a swelling bentonite, sometimes sets up in the crutcher in which it is being prepared. Often such solidification is spontaneous after the bentonite has been added to the crutcher, and sometimes occurs only minutes after such addition. When 0.5 to 5% of magnesium sulfate is incorporated in the crutcher mix such undesirable setting of the mix is delayed or prevented entirely, and crutching times of at least one hour (and sometimes appreciably longer) are attained, after which the crutcher slurry is still miscible, and is pumpable to a spray drying tower. In addition to sodium bicarbonate and sodium carbonate the crutcher mixes may also contain sodium sesquicarbonate (sometimes at least partially in replacement of the bicarbonate and carbonate), sodium sulfate and small amounts of sodium silicate, with the proportion of sodium silicate being no more than 2% of the crutcher mix, and desirably being nil. No citric acid or citrate is required to help maintain the fluidity of the crutcher slurry and citric materials are omitted from the crutcher mixes.

The invention also relates to the crutcher slurries made, a process for making spray dried beads from the described crutcher slurries, base beads made from the slurries by such spray drying process, and built synthetic organic nonionic detergent compositions made from such base beads by absorption therein of suitable nonionic detergent.

9 Claims, No Drawings

RETARDING SETTING OF CRUTCHER SLURRY FOR MANUFACTURING BASE BEADS FOR DETERGENT COMPOSITIONS

This invention relates to a process for retarding or preventing the setting of a miscible and pumpable crutcher slurry which is suitable for spray drying to base beads that are useful for the manufacture of detergent compositions. More particularly, the invention relates to retarding or preventing the setting of such slurries which include relatively high proportions of normally solid materials and relatively little water, and in which the bentonite is present together with zeolite and a water soluble sodium salt of a certain type.

In the preparation of detergent compositions of the built synthetic organic nonionic detergent type it is often difficult or impossible to satisfactorily spray dry aqueous crutcher mixes containing appreciable proportions of synthetic organic nonionic detergent. Such detergents can be decomposed during spray drying and often such decomposition is evidenced by the formation of plumes which exit from the spray tower with exhausted drying gases. Consequently, so that significant percentages of nonionic detegent may be included in particulate detergent compositions of desired bead structure, essentially inorganic aqueous crutcher mixes have been made and spray dried to desirable bead form, after which normally solid (or sometimes pasty) nonionic detergent, in liquid state at elevated temperature, has been sprayed onto moving surfaces of such beads, as in a rotary drum in which the beads are tumbled during the spray application of the detergent.

In some detergent compositions wherein water softening inorganic material of the zeolite type has been employed as a builder it will often be desirable to utilize other builder salts, such as sodium bicarbonate, sodium carbonate and/or sodium sesquicarbonate, sometimes with a filler salt, such as sodium sulfate. Sodium silicate was formerly a preferred component of such detergent compositions but it adversely reacts with zeolite in some instances, forming agglomerates which deposit on laundry washed with the detergent composition. Such deposits are objectionable and accordingly, although sodium silicate is known to have a strengthening effect on detergent beads, it is very preferably omitted from the present nonionic detergent-based products. The swelling bentonites, such as western or Wyoming bentonites, help to strengthen the base beads while still permitting the absorption of relatively large percentages of nonionic detergents into such beads. Additionally, they contribute fabric softening effects to washed laundry. However, it has been discovered that in crutcher mixes containing relatively high proportions of solids and relatively little moisture, when bentonite is present with zeolite and water soluble inorganic salts which are sources of sodium ion the crutcher slurry sometimes becomes immiscible and unpumpable within a relatively short time after the slurry is made. In such situations it may be necessary to shut down the crutcher and the accompanying spray drying tower dependent on it for feed, while the solidified crutcher mix is laboriously chopped up and removed from the crutcher. Even if setting in the crutcher occurs only occasionally it cannot be tolerated at all and therefore the making of high solids content crutcher mixes, (with corresponding increases in spray tower drying efficiencies and throughput rates) could not be practiced for many formulations, such as those of zeolite, bentonite, inorganic salt source of sodium ion and water. However, it has now been discovered that by addition of a small percentage of magnesium sulfate to the crutcher mix such setting or gelation thereof can be retarded or prevented entirely and the mix will remain miscible and pumpable for at least an hour, and often much longer.

In accordance with the present invention a process for retarding or preventing the setting of a miscible and pumpable crutcher slurry which is suitable for spray drying to base beads for a built nonionic detergent composition, which slurry comprises from 55 to 75% of solids and 45 to 25% of water, and comprises from 10 to 40% of a water softening zeolite, 30 to 50% of water soluble salt(s) selected from the group consisting of sodium bicarbonate, sodium carbonate, sodium sesquicarbonate, sodium sulfate and sodium silicate, and mixtures thereof, with the content of sodium silicate being no more than 2%, and 2 to 10% of a swelling bentonite, comprises preparing a crutcher slurry which is of the described composition and which contains from 0.5 to 5% of magnesium sulfate, and mixing such composition in a crutcher during preparation thereof. Preferably the crutcher mix will contain no water soluble sodium silicate and will contain no citric material, such as citric acid or water soluble salt thereof. The invention also relates to the miscible and pumpable crutcher slurry that may be produced by the process of the invention, a process for making spray dried base beads from such a slurry, the base beads resulting, and a built detergent composition comprising such base beads and nonionic detergent absorbed thereby.

The closest prior art known to applicant in U.S. Pat. No. 4,368,134 (Kaeser), in which the problem of preventing gelation in aqueous crutcher slurries containing zeolite, sodium bicarbonate, sodium carbonate and sodium silicate (little or none of which silicate may be present) is overcome by utilization of a citric material, such as citric acid or water soluble citrate, in conjunction with magnesium sulfate in the crutcher mix. However, the compositions of such patent do not include bentonite, which contributes its own effects to the setting of the crutcher mix, and the patent requires the employment of citric material, which is avoided in the present invention. Also relevant in U.S. patent application Ser. No. 492,395, which discloses low silicate content base beads containing zeolite, bentonite, sodium carbonate and sodium bicarbonate, optionally with sodium polyacrylate. In the specification of the patent application it is mentioned that processing aids, such as combinations of citric acid and magnesium sulfate, may be useful to prevent gelation or freezing of aqueous crutcher mixes of the components of the base beads. However, such patent application does not teach that magnesium sulfate alone is effective nor are there described in the patent application the improvements in the properties of the base beads when magnesium sulfate is incorporated in the crutcher mix of the present invention.

The water softening zeolites of the present crutcher mixes and base beads are crystalline, amorphous or mixed crystalline-amorphous zeolites which are normally at least partially hydrated and which have high exchange capacities for calcium ion, normally from 200 to 400 or more milligram equivalents of calcium carbonate hardness per gram of the aluminosilicate, preferably 250 to 350 mg. eq./g. While other zeolites can also be employed, it is preferred that the zeolites used be sodium aluminosilicates containing about one molar proportion of sodium oxide, about one molar proportion of alumina and two or three molar proportions of silica, with up to nine molar proportions of water of hydration, preferably from about 2.5 to 6 such proportions, e.g., hydrated zeolite A. The hydrated form of the zeolite is preferably employed and the extent of hydration is normally about 15 to 70% of capacity, which is about 5 to 30% of water of hydration, preferably about 10 or 15 to 25%, such as 17 to 22%, e.g., 20%. The zeolite, if crystalline, as is preferred, will have a network of substantially uniformly sized pores in the range of about 3 to 10 Ångstroms, often being about 4 Ångstroms (as in zeolite 4A). The zeolite ultimate particle diameters will usually be up to 20 microns, e.g., 0.005 or 0.01 to 20 microns, more preferably being 0.01 to 15 microns, e.g., 3 to 12 microns, and especially preferably being of 0.01 to 8 microns mean particle size, e.g., 3 to 7 microns, if crystalline, and 0.01 to 0.1 micron, e.g., 0.01 to 0.05 micron, if amorphous. Although the ultimate particle sizes are much lower, usually the zeolite particles will be of sizes within the range of 100 to 400 mesh, preferably 140 to 200 or 325 mesh. Zeolites of smaller sizes will often become objectionably dusty and those of larger sizes may not be sufficiently and satisfactorily uniformly distributed with other normally solid components of the crutcher mix to form uniform base beads and exert best building action.

The bentonite utilized is preferably a Wyoming or western bentonite having a swelling capacity in the range of 3 to 15 or 20 ml./gram, often preferably 7 to 15 ml./g., and its viscosity, at a 6% concentration in water, will usually be in the range of 3 to 30 centipoises, preferably 8 to 30 centipoises. Preferred swelling bentonites of the type are sold under the trademark Mineral Colloid, as industrial bentonites, by Benton Clay Company, an affiliate of Georgia Kaolin Co. Such materials were formerly marketed under the trademark THIXO-JEL by such company. They are selectively mined and beneficiated bentonites, and those considered to be most useful are available as Mineral Colloid 101, etc., and correspond to those formerly sold as THIXO-JELs No's. 1, 2, 3 and 4. These materials have pH's (6% concentration in water) in the range of 8 to 9.4, maximum free moisture contents of about 8% and specific gravities of about 2.6, and for the pulverized grade about 85% passes through a 200 mesh U.S. Sieve Series sieve. Also useful are Texas bentonites sold by Georgia Kaolin Co. under the trademark Bentolite, such as Bentolites L and H. While beneficiated Wyoming bentonites are preferred as components of the present compositions, various other swelling bentonites are also useful, especially when they form only a minor proportion of the total bentonite present.

It is desirable to limit maximum free moisture content, as was mentioned, but it is more important to make certain that the bentonite being employed includes enough moisture, most of which is considered to be present between adjacent plates of the bentonite, to facilitate quick disintegration of the bentonite and any adjacent materials in the particles when such particles or detergent compositions containing them are brought into contact with water, such as when the detergent composition is added to the wash water. It has been found that at least about 2%, preferably at least 3%, more preferably, about 4% and most preferably 5% or more, to about 8% of water should be present in the bentonite initially, before it is admixed with the other bead components in the crutcher, and such a proportion of moisture should also be present after spray drying. In other words, overdrying to the point where the bentonite loses its "internal" moisture can significantly diminish the utility of the present compositions. When the bentonite moisture content is too low the bentonite does not act to the extent that is possible to prevent any possible silicate-zeolite agglomerates from being formed and it also does not aid enough in disintegrating the beads in the wash water. Also, when the bentonite is of satisfactory moisture content it exhibits an exchangeable calcium oxide percentage in the range of about 1 to 1.8 and with respect to magnesium oxide such percentage will normally then be in the range of 0.04 to 0.41, which exchange capacity is desirable.

The sodium bicarbonate employed may be of standard commercial grade or of higher purity, as may be desired. Sodium carbonate may be utilized as soda ash or any suitable hydrate, such as the monohydrate or washing soda. Sodium sulfate, if present may also be employed in anhydrous or hydrated form, e.g., Glauber's salt. Such builder and filler materials are normally charged to the crutcher as comparatively finely divided powders, such as those of particle sizes in the 60 to 160 mesh (or No's. 60 to 160, U.S. Sieve Series) range. Sodium silicate, if present, will normally be charged to the crutcher as a concentrated aqueous solution, e.g., of 47.5% solids content, and the sodium silicate will be of $Na_2O:SiO_2$ ratio in the range of 1:1.6 to 1:3, preferably 1:2 to 1:2.6, and more preferably about 1:2.4. The magnesium sulfate used by be anhydrous or hydrated (epsom salts) and like the other powdered components, will usually be finely divided before addition to the crutcher. Technical grade magnesium sulfate is satisfactory, as are purer grades thereof and such is also true with respect to the other inorganic salt components of the crutcher mix. While various components of the crutcher mix may be employed in anhydrous or hydrated form, allowance should be made in formulating the crutcher mix for the water contents of the hydrates and for any other water present in the materials charged to the crutcher when such such water becomes part of the aqueous medium in the crutcher (such should be counted as part of the water content of the slurry). Such is the case for the various mentioned hydrates and moisture containing components of the crutcher mix except for the zeolites, of which the water of hydration is considered to be a part.

Various adjuvants may be present in the crutcher with the active detergent builder and filler components, providing that such are stable during spray drying. Among such adjuvants there may be mentioned, without limitation: coloring agents, of which pigments such as ultramarine blue and titanium dioxide are often preferred; fluorescent brighteners; anti-redeposition agents, such as sodium carboxymethylcellulose; dispersants; bead structure and density control agents, such as sodium polyacrylates of a molecular weight in the range of 1,000 to 5,000, preferably 1,000 to 2,000 (of which those sold under the trademark Alcosperse are often preferred, e.g., Alcosperse 104 and 107); and bactericides.

After spray drying of the crutcher mix to form the base beads various materials may be sprayed onto or otherwise combined with the base beads to form final built detergent compositions. Primary among such materials are the nonionic detergents which may be sprayed onto moving surfaces of the base beads, such as those continuously regenerated in a tumbling drum. Various nonionic detergents of satisfactory physical characteristics may be utilized, including condensation products of ethylene oxide and propylene oxide with each other and with hydroxy-containing bases, such as nonyl phenol and Oxo-type alcohols, but it is highly preferred that the nonionic detergent be a condensation product of ethylene oxide and higher fatty alcohol. In such products the higher fatty alcohol is of 10 to 20 carbon atoms, preferably 12 to 16 carbon atoms, and the nonionic detergent contains from about 3 to 20 or 30 ethylene oxide groups per mole, preferably from 6 to 12. More preferably, the nonionic detergent will be one in which the higher fatty alcohol is of about 12 to 13 or 15 carbon atoms and which contains from 6 to 11 moles of ethylene oxide, e.g., 6, 7, 11. Such detergents are made by Shell Chemical Company and are available under the trade names Neodol® 23-6.5 and 25-7. Among their especially attractive properties, in addition to good detergency with respect to oily soils and stains on goods to be washed, is a comparatively low melting point, which is still apprecially above room temperature, so that they may be sprayed onto base beads as a liquid which quickly solidifies in the pores of the beads. Various other materials may be sprayed onto the base beads and absorbed thereby, either dissolved or dispersed in the nonionic detergent or separate from it, or may be mixed with such beads. Such adjuvants include: perfumes; enzymes, e.g., proteases and amylases; bleaches, e.g., sodium perborate; fabric softening agents, e.g., distearyldimethylammonium chloride; soil release promoting agents, e.g., ethoxylated terephthalates; and flow promoting agents, e.g., special clays.

The descriptions of various components of the crutcher mix, spray dried base beads and final detergent compositions given above are relatively short but further descriptions of suitable such materials may be found in U.S. Pat. No. 4,368,134 and U.S. patent application Ser. No. 492,395, both of which were mentioned previously, and also in abandoned parent and grandparent applications of Ser. No. 492,395. Ser. Nos. 279,550 and 238,619, respectively, which are incorporated herein by reference.

The crutcher slurries or mixes of the present invention are high solids content slurries, sometimes or more than 65% of solids. (By "solids" it is meant materials which are normally solid but which may either be dissolved or dispersed in the crutcher slurry. Water of hydration of such solids is not included as a portion of the solids content when the crutcher slurry component dissolves or when such water of hydration separates from such component in the slurry). Normally the solids content of the crutcher mix will be 55 to 75% and the balance of such slurry will be water (45 to 25% thereof). Preferably such solids content will be 60 to 72%, with the balance being water, and most preferably the solids content will be about 69%. The zeolite content of the crutcher mix will be from 10 to 40%, preferably 20 to 35% and more preferably about 27%, and the water soluble builder and/or filler salt content (exclusive of magnesium sulfate) will be from 30 to 50%, preferably 35 to 45%, e.g., about 36 or 37%. Of the builder salts, the sodium bicarbonate content will preferably be from 15 to 25%, more preferably being about 21% and the sodium carbonate content will preferably be from 10 to 20%, more preferably being about 15%. The proportion of sodium silicate present in the slurry will be limited to no more than 2%, preferably will no more than 1% and most preferably will be nil. Bentonite will be present in the crutcher mixes of the invention at a concentration of 2 to 10%, preferably 3 to 8% and more preferably about 4%. The magnesium sulfate content will be 0.5 to 5%, preferably 1 to 3% and more preferably 1 or 2%. In all such cases percentages of components given are on any anhydrous basis, except for the zeolite and the bentonite (the bentonite contains but a relatively small proportion of water, which helps to give it its lubricating properties). Other water soluble sodium salts may be present in the crutcher mix, as adjuvants or for builder or filler purposes, but the sodium ion released in the crutcher thereby should not be such as to cause the crutcher mix to contain more sodium ion than would result from a mixutre of 29% of sodium bicarbonate and 21% of sodium carbonate. Of the adjuvants, the preferred sodium polyacrylate may be present in a suitable proportion, which normally is from 0.1 to 0.6%, more preferably about 0.4%, and any pigment, such as ultramarine blue, may be present to the extent of about 0.1 to 1%, more preferably about 0.2%. The total adjuvant content usually should not exceed 10%, preferably being no more than 5%, and more preferably will be limited to 1 or 2%. For best properties in the base beads and final detergent composition and for quicker processing and the savings of the costs of such materials, the presence of citric materials, such as citric acid and citrates, will be avoided.

The base beads which are made by spray drying the crutcher mix will comprise from 10 to 55% of water softening zeolite, preferably 25 to 50% thereof and more preferably about 35 or 40% thereof. The sodium bicarbonate content will be less proportionately in the base beads than in the crutcher mix because of decomposition of the bicarbonate to carbonate in the spray tower, and the carbonate content will be correspondingly increased. Thus, the sodium bicarbonate content of the base beads will be from 8 to 20%, preferably about 16%, and the sodium carbonate content will be from 15 to 40%, preferably about 30%. The content of sodium silicate will be no more than 2.7% and preferably will be nil and the contents of sodium sesquicarbonate and sodium sulfate will be such that the sodium ion releasable from the builder and filler salts in the crutcher mix will not exceed the proportion previously specified. The total content of water soluble builder and filler salts for the base beads will be in the range of 40 to 70%, preferably 45 to 60%. Bentonite will be from 2 to 15% of the base beads, preferably 4 to 11% thereof and more preferably about 5%, while the magnesium sulfate content will be in the range of 0.7 to 7%, preferably 1 to 4% and more preferably about 1.4%. The moisture content of the base beads will usually be from 2 to 10%, preferably being 3 to 8% and more preferably 6 or 7%. Adjuvants content will preferably be limited to about 7% and more preferably will be held to 1 or 2%, with contents of polyacrylate being 0.1 to 0.9%, e.g., 0.5%, and that of pigment, such as ultramarine blue, most preferably being about 0.2%.

The final detergent composition, made by the addition to the base beads of the nonionic detergent and any other suitable adjuvants, will normally contain from 10 to 25% of nonionic detergent, preferably 15 to 22% thereof, and usually from 0.1 to 5% of adjuvants), such as perfume, enzyme(s), dye, fabric softener and flow agent (clay)added, and ranges of percentages of the components will be adjusted accordingly.

The crutcher mix that is being treated by the processes of this invention to retard or prevent the setting thereof and to maintain its miscible and pumpable crutcher slurry condition will usually be at atmospheric pressure and at a temperature in the range of 20° to 70° C., preferably 25° to 50° C., e.g., 32°, 35° or 40° C. However, in some circumstances it may be desirable to raise the temperature to near the upper limit of the given range and sometimes that normally practicable limit may be exceeded by as much as 5° or 10°. Mixing times to produce the crutcher slurry may vary but usually the additions and mixing will take from five minutes to 20 minutes. While the order of addition of most components of the slurry is not critical it will generally be preferred to incorporate the formula amount of water first, followed by zeolite, adjuvants, magnesium sulfate, sodium bicarbonate and sodium carbonate, with the bentonite being added last. The order of addition of the sodium bicarbonate and sodium carbonate may be reversed with little apparent effect. It is considered highly desirable that the magnesium sulfate be added before the bentonite and preferably also before the sodium bicarbonate and sodium carbonate. Furthermore, the bentonite should be admixed last. All additions of components are with mixing in the crutcher, which may be effected with conventional blade or propeller mixers or with other mixers of suitable designs. After completion of mixing it is desirable to hold the crutcher mix no more than about an hour or so, although longer periods of stability are often obtained, e.g., four hours and at least two hours is typically the result.

It is a feature of the invention that although when magnesium sulfate is not present the addition of bentonite will thicken the crutcher slurry and often will cause it to set spontaneously shortly after addition of the bentonite, in the presence of the magnesium sulfate the slurry viscosity is not changed due to the bentonite addition, even at relatively low temperatures, such as 30° or 35° C.

The crutched slurry, with the various components thereof dissolved or in particulate form and uniformly distributed therein, in part due to the desirable effects of the magnesium sulfate, is transferred in usual manner to a spray drying tower, which is located near the crutcher. The slurry is normally dropped from the bottom of the crutcher to a positive displacement pump, which forces it at high pressure through spray nozzles at the top of a conventional spray tower (countercurrent or concurrent), wherein the droplets of the slurry fall through a hot drying gas, which is usually composed of fuel oil or natural gas combustion products, in which the droplets are dried to desired absorptive bead form, suitable for absorbing significant proportions of nonionic detergent. During the drying, part of the bicarbonate (often $\frac{1}{3}$ to $\frac{1}{2}$ thereof) is converted to carbonate, with the release of carbon dioxide, which appears to improve the physical characteristics of the beads made, so that they become more absorptive of liquids, such as the liquid nonionic detergent to be post-sprayed onto them.

After drying, the product is screened to desired size, e.g., 10 to 100 mesh, U.S. Standard Sieve Series, and is ready for application of nonionic detergent spray thereto, with the beads being either in warm or cooled (to room temperature) condition. However, the nonionic detergent will usually be at an elevated temperature, e.g., 45° to 55° C., to assure that it will be liquid; yet, upon cooling to room temperature, it will be a solid, often resembling a waxy solid. Even if at room temperature the detergent is somewhat tacky this characteristic does not make the final composition poorly flowing because the detergent penetrates to below the bead surfaces.

The importance of retarding or preventing setting of the crutcher slurry in the crutcher or in the piping or pumps in the spray drying plant cannot be overestimated. By means of the present invention high solids content crutcher formulas containing bentonite, zeolite, sodium bicarbonate and sodium carbonate, which previously were unacceptable for commercial processing, can now be made, resulting in marketable, improved nonionic detergent compositions. It is considered that the effects obtained are unobvious from the prior art because previously it was taught that for bentonite-containing compositions a citric material was essential to obtain retardation of gelation or setting. Also, the mechanism of setting for compositions containing bentonite and no silicate is considered to be different from that for compositions wherein carbonate and silicate are present in substantial proportions. Similarly, the reactive agglomeration of silicate and zeolite is considered to be a different mechanism. Thus, it is unobvious that magnesium sulfate alone would prevent setting up of the present crutcher mixes.

Base beads made from the present crutcher mixes exhibit unexpectedly improved physical characteristics, compared to control beads made from crutcher mixes not containing the magnesium sulfate and of lower solids contents. Thus, bead strength (resistance to compression) and nonfrangibility (resistance to size reduction during handling) are increased. Such is especially important with respect to base beads, which are subsequently transported by conveying means to apparatuses, such as tumbling drums, wherein nonionic detergent is to be applied to them. The beads of this invention maintain their initial sizes better, leading to less waste after treatment with nonionic detergent, and because finely powdered base bead material is not produced or is produced to a much more limited extent, the final beads made do not have such powder adhering to them, making their appearance less attractive. Of course, in addition to improving the appearance of the final product, which is important for products that are intended to be sold for household use in retail markets, it is even more important that re-screening is not required and that the beads are strong enough to resist size reduction, which otherwise results in waste or the need to reprocess some of the product.

The base beads very satisfactorily absorb nonionic detergent to product the described detergent composition, which are effective and commercially acceptable products. The presence of the magnesium sulfate in such product has no adverse affect thereon and in some circumstances may actually be beneficial with respect to washing effects.

The following examples illustrate but do not limit the invention. Unless otherwise mentioned all parts are by weight and all temperatures are in °C.

EXAMPLE 1

| Component | Parts |
|---|---|
| Water (deionized) | 30.2 |
| Zeolite (Linde 4A, 20% hydrated) | 26.4 |
| Sodium polyacrylate (Alcosperse 107) | 0.4 |
| Ultramarine blue | 0.2 |

-continued

| Component | Parts |
|---|---|
| Magnesium sulfate | 2.0 |
| Sodium bicarbonate | 19.8 |
| Sodium carbonate | 14.0 |
| Bentonite, swelling (Mineral Colloid 101) | 4.2 |

A slurry of the above components is made, adding them to a mixing or crutching vessel in the order given over a period of about ten minutes with continuous mixing during that time. The temperature of the mix is maintained at about 38° C. and mixing is continued after all the components of the crutcher mix are present therein. It is found that the product does not set even after 1¼ hours of mixing, and the viscosity thereof is approximately the same as before addition of the bentonite, with the mix being pumpable and sprayable through conventional spray tower spray nozzles to spray dried base beads of good appearance, strength and resistance to abrasion and size reduction due to handling.

The experiment described above is repeated with the sole change being that the content of magnesium sulfate is reduced to one part and that of sodium carbonate is increased to 15 parts. The same procedure is followed and it is noted that the slurry is still miscible and pumpable after over an hour of mixing after addition of the bentonite.

In a variation of the preceding experiments the magnesium sulfate is omitted, the zeolite content is increased to 27.4% and the sodium carbonate content is 15.0%, with the other components being the same as previously described and being present in the same proportions. At approximately seven minutes after addition of the bentonite to the slurry the crutcher mix sets up to form an unpumpable solid.

The formulations containing the magnesium sulfate, when spray dried to a moisture content in the 5 to 10% range in a hot drying gas in a conventional spray drying tower, form stronger base beads containing lesser proportions of fines, compared to similar formulations which do not contain magnesium sulfate and which employ larger proportions of water so as to maintain crutcher stability and avoid premature setting of the crutcher mix. When the base beads containing magnesium sulfate are sprayed with nonionic detergent (Neodol 23-6.5) so as to produce a built nonionic detergent composition containing 20% of the nonionic detergent the product is very satisfactory and is commercially acceptable to the consumer (after being perfumed). It washes well, flows freely, is of attractive appearance and does not fracture readily on handling, so that excessive fines in the product are avoided.

EXAMPLE 2

A crutcher slurry is made over a period of about ten minutes by mixing together the following components in the order given: 490 parts of water; 2.5 parts of ultramarine blue and 6.6 parts of Alcosperse 107 (with the ultramarine blue and Alcosperse 107 having been premixed); 436 parts of zeolite 4A; 27 parts of magnesium sulfate; 213 parts of soda ash; 315 parts of sodium bicarbonate; and 67 parts of bentonite (Mineral Colloid 101). The mixing temperature is maintained in the range of 38° to 47° C. After addition of the magnesium sulfate the slurry thickened but was thinned satisfactorily by the addition of 20 parts of water thereto. Upon addition of the bentonite the temperature rose to about 47° C. but the product maintained its fluidity, with no increase in viscosity. Mixing could be continued for over an hour (up to four hours) with no increase in viscosity and with the crutcher slurry remaining miscible and pumpable.

When the above experiment is repeated but with half as much magnesium sulfate being employed (13 parts) and with the soda ash content being increased correspondingly to 226 parts, while operating at temperature in the range of 32° to 42° C., a pumpable slurry is produced and is maintained for a period of fifty minutes (and longer) after addition of the bentonite to the mix.

EXAMPLE 3

Base beads like those of Example 1 are manufactured in commercial detergent plant equipment, including crutcher, countercurrent spray drying tower and tumbling drum for application of nonionic detergent to the product. The crutcher mix is one like that of Example 1 but containing 57% solids (plant experimentation will continue to further increase solids contents of such crutcher mixes), which contains 1% of magnesium sulfate, and the bentonite employed is THIXO-JEL No. 1 (now Mineral Colloid 101). There is also manufactured a control product, using 50% solids crutcher mix, to avoid premature setting, and omitting the magnesium sulfate (with the zeolite content increased by the amount of omitted magnesium sulfate). The crutching is over a period extending from ½ to 1½ hours before the mix is dropped and pumped to the spray tower and mixing of all the components together takes about 15 minutes of such time. The crutcher temperature is about 40° to 50° C. and the spray tower temperature is in the range of 200° to 500° C. Standard pressure spray nozzles are employed and the product is dried to a moisture content of about 7%, after which it is screened so as to be of particle sizes in the range of No's. 10 to 100, U.S. Sieve Series.

The base beads are subjected to a standard frangibility test and it is found that the control product is substantially more frangible than the experimental product. Thus, after shaking 100 grams of beads in a Combs Gyratory Sifting Machine for ten minutes, along with ten 1 cm. diameter ceramic balls, the experimental product has its size reduced much less severely than the control product. This is verified by screening the beads through No's. 12, 20, 30, 40, 50 and 100, U.S. Sieve Series sieves both before and after subjection to agitation in the Combs Gyratory Sifting Machine. When tested for compressibility the experimental base bead is less compressible, as is the final detergent product, made by spraying onto tumbling base beads of enough Neodel 23-6.5 at a temperature of about 48° C. to make a detergent composition containing about 22% of such nonionic detergent. In the compressibility test a weight is dropped twice onto a column of 200 milliliters of product to be tested and the height of such column is measured before and after. The compressibility, in %, is 100 times the difference in such heights divided by the initial height.

In similar tests products are made in the pilot plant and in a commercial plant of variations of the previous formulations containing 3% of Bentolite L and 1% of magnesium sulfate in the experimental formula (with the content of zeolite being increased 2%) and of such formula without magnesium sulfate (with the zeolite being increased an additional 1%). Again, the experimental crutcher mix is pumpable and the base beads are superior in resistance to size reduction and in compressive strength.

In a further experiment, variations of the foregoing experiments, employing 1.5% of THIXO-JEL No. 1 and different manufacturing plant equipment, with 1% of magnesium sulfate in the experimental crutcher mix and no magnesium sulfate in the control, the previous favorable findings were again confirmed with the experimental product being more resistant to compression and more resistant to size reduction, so that lesser proportions of fines result after handling or testing. Also, it was noted that the experimental product appeared to result in larger spray dried base beads (and larger finished detergent composition beads).

In the aforementioned experimental formulations similar excellent results are obtainable when relatively small proportions, e.g., 5% of each, of sodium sulfate and sodium sesquicarbonate are present and when 1% of sodium silicate is present, although it is considered that better product results when the sodium silicate is omitted. Similarly, when other zeolites, such as zeolite X and zeolite Y and other type A zeolites are employed such results will be obtained. This is also the case when other types of swelling bentonites, such as beneficiated bentonites which were initially of low swelling capacity, are utilized. Of course, it makes no difference whether anhydrous magnesium sulfate is employed, as in the foregoing examples, or epsom salts are used, providing that the same proportion of anhydrous magnesium sulfate (not counting water of hydration) is present.

The proportions of various components in the previous formulas, and the total solids contents may be varied ±10% and ±25%, providing that they are within the ranges previously given, and comparable results will be obtained. Similarly, when other polyethoxylated higher fatty alcohols or other nonionic detergents, such as block copolymers of ethylene oxide and propylene oxide or polyethoxylated alkylphenols, are used as the nonionic detergent to be sprayed onto the base beads, effective built nonionic detergent compositions result.

The invention has been described with respect to various illustrations and embodiments thereof but is not to be limited to these because one of skill in the art, with the present specification before him, will be able to utilize substitutes and equivalents without departing from the invention.

What is claimed is:

1. A process for retarding or preventing the setting of a miscible and pumpable crutcher slurry which is suitable for spray drying to base beads for a built nonionic detergent composition, which slurry comprises from 55 to 75% of solids and 45 to 25% of water, and comprises from 10 to 40% of a water softening zeolite, 30 to 50% of water soluble salt(s) selected from the group consisting of sodium bicarbonate, sodium carbonate, sodium sesquicarbonate, sodium sulfate and sodium silicate, and mixtures thereof, with the content of sodium silicate being no more than 2%, and 2 to 10% of a swelling bentonite, which comprises preparing a crutcher slurry which is of the described composition and which contains from 0.5 to 5% of magnesium sulfate, and 0% of citric material and mixing such composition in a crutcher during preparation thereof.

2. A process according to claim 1 wherein the crutcher slurry comprises from 60 to 72% of solids and 40 to 28% of water, and comprises from 20 to 35% of a hydrated crystalline zeolite, 35 to 45% of water soluble salt(s) selected from the group consisting of sodium bicarbonate, sodium carbonate, sodium sesquicarbonate, sodium sulfate and sodium silicate, and mixtures thereof, of which 15 to 25% is sodium bicarbonate and 10 to 20% is sodium carbonate, 3 to 8% of bentonite and 1 to 3% of magnesium sulfate, the temperature of the slurry is in the range of 20° to 70° C. and mixing is continued for at least one hour after completion of the making of the slurry.

3. A process according to claim 2 wherein the bentonite is a western bentonite and the slurry is at a temperature in the range of 25° to 50° C., contains from 0.1 to 0.6% of sodium polyacrylate and is free of sodium sulfate, sodium silicate and citric material, and wherein at least a part of the crutcher mix is pumped out of the crutcher to a spray drying tower and is spray dried therein after said mixing.

4. A process according to claim 3 wherein the crutcher slurry, with magnesium sulfate incorporated therein, consists of about 31% of water, 27% of zeolite A, 21% of sodium bicarbonate, 15% of sodium carbonate, 4% of bentonite, 0.4% of sodium polyacrylate, 0.2% of pigment and 1% of magnesium sulfate.

5. A miscible and pumpable crutcher slurry which is suitable for spray drying to base beads useful for the manufacture of a built nonionic detergent composition, which slurry comprises from 55 to 75% of solids and 45 to 25% of water and comprises from 10 to 40% of a water softening zeolite, 30 to 50% of water soluble salt(s) selected from the group consisting of sodium bicarbonate, sodium carbonate, sodium sesquicarbonate, sodium sulfate and sodium silicate, and mixtures thereof, with the content of sodium silicate being no more than 2%, 2 to 10% of a swelling bentonite, 0.5 to 5% of magnesium sulfate and 0% of citric material.

6. A slurry according to claim 5 which is at a temperature in the range of 20° to 70° C. and which comprises from 60 to 72% of solids and 40 to 28% of water, and comprises from 20 to 35% of a hydrated crystalline zeolite, 35 to 45% of water soluble salt(s) selected from the group consisting of sodium bicarbonate, sodium carbonate, sodium sesquicarbonate, sodium sulfate and sodium silicate, and mixtures thereof, of which 15 and 25% is sodium bicarbonate and 10 to 20% is sodium carbonate, 3 to 8% of bentonite and 1 to 3% of magnesium sulfate.

7. A slurry according to claim 6 wherein the bentonite is a western bentonite and the slurry is at a temperature in the range of 25° to 50° C., contains from 0.1 to 0.6% of sodium polyacrylate and is free of sodium sulfate, sodium silicate and citric material.

8. A slurry according to claim 7 which consists of about 31% of water, 27% of zeolite A, 21% of sodium bicarbonate, 15% of sodium carbonate, 4% of bentonite, 0.4% of sodium polyacrylate, 0.2% of pigment and 1% of magnesium sulfate.

9. A process for making spray dried base beads suitable for conversion to a built nonionic detergent composition by spraying of normally solid nonionic detergent in liquid state onto moving surfaces of such beads, which comprises making a crutcher slurry in accordance with claim 5 and spray drying it in a heated drying gas to produce spray dried beads of particle sizes in the range of No's. 10–100, U.S. Sieve Series.

* * * * *

UNITED STATES PATENT AND TRADEMARK OFFICE

CERTIFICATE OF CORRECTION

PATENT NO. : 4,510,066

DATED : April 9, 1985

INVENTOR(S) : David C. Saar

It is certified that error appears in the above-identified patent and that said Letters Patent is hereby corrected as shown below:

The term of this patent subsequent to January 11, 2000, has been disclaimed.

Signed and Sealed this

*Twenty-eighth* Day of *May 1985*

[SEAL]

*Attest:*

DONALD J. QUIGG

*Attesting Officer*

*Acting Commissioner of Patents and Trademarks*